US006550185B2

(12) United States Patent
Schlattor

(10) Patent No.: US 6,550,185 B2
(45) Date of Patent: Apr. 22, 2003

(54) VEHICLE DOOR AND WINDOW REGULATOR ASSEMBLY FOR DRIVING A WINDOW IN A HELICAL PATH

(75) Inventor: Stanley Schlattor, Cookeville, TN (US)

(73) Assignee: Meritor Light Vehicle Technology, LLC, Troy, MI (US)

( * ) Notice: Subject to any disclaimer, the term of this patent is extended or adjusted under 35 U.S.C. 154(b) by 0 days.

(21) Appl. No.: 09/921,416

(22) Filed: Aug. 2, 2001

(65) Prior Publication Data

US 2003/0024166 A1 Feb. 6, 2003

(51) Int. Cl.[7] ..... E05F 11/48
(52) U.S. Cl. ..... 49/352; 49/348; 49/372
(58) Field of Search ..... 49/348, 349, 352, 49/372, 374, 375, 376, 378, 208, 260, 213, 214

(56) References Cited

U.S. PATENT DOCUMENTS

| | | | | | |
|---|---|---|---|---|---|
| 3,466,803 | A | * | 9/1969 | Packett | 49/441 |
| 3,541,732 | A | * | 11/1970 | Hanson | 49/440 |
| 3,834,080 | A | | 9/1974 | Lystad | |
| 4,441,276 | A | | 4/1984 | Chikaraishi | |
| 4,442,632 | A | * | 4/1984 | Greco et al. | 49/352 |
| 4,449,326 | A | | 5/1984 | Hori et al. | |
| 4,658,546 | A | * | 4/1987 | Moriyama | 49/352 |
| 4,706,412 | A | * | 11/1987 | Korbrehel | 49/352 |
| 4,721,006 | A | * | 1/1988 | Darmon | 74/519 |
| 4,788,794 | A | * | 12/1988 | Miller | 49/214 |
| 4,819,377 | A | | 4/1989 | Bauer et al. | |
| 4,829,630 | A | * | 5/1989 | Church et al. | 49/93 R |
| 4,905,413 | A | * | 3/1990 | Kuki et al. | 49/362 |
| 4,910,914 | A | * | 3/1990 | Asoh | 49/214 |
| 5,009,035 | A | * | 4/1991 | Kuki et al. | 49/352 |
| 5,036,621 | A | * | 8/1991 | Iwasaki | 49/428 |
| 5,054,238 | A | * | 10/1991 | Glossop et al. | 49/211 |
| 5,074,077 | A | | 12/1991 | Toyoshima et al. | |
| 5,076,014 | A | * | 12/1991 | Cuyl | 49/140 |
| 5,497,578 | A | | 3/1996 | Wautelet et al. | |
| 5,505,022 | A | * | 4/1996 | Shibata et al. | 49/352 |
| 5,647,094 | A | | 7/1997 | Mariel | |
| 5,771,534 | A | | 6/1998 | Church | |
| 5,946,860 | A | * | 9/1999 | Weber et al. | 49/375 |
| 6,055,778 | A | * | 5/2000 | Ide et al. | 49/375 |
| 6,295,762 | B1 | * | 10/2001 | Nemoto | 49/374 |

* cited by examiner

*Primary Examiner*—Gregory J. Strimbu
(74) *Attorney, Agent, or Firm*—Carlson, Gaskey & Olds

(57) ABSTRACT

A window regulator for a door that includes a portion that defines a helical path. The window regulator includes a drive assembly having an actuator coupled to a cable for moving a window along the helical path. A single guide having opposing channels extends longitudinally and defines a drive path, which is different from the helical path. A lift plate is movable along the guide for supporting the window, and the cable is connected to the lift plate for moving the lift plate along the guide. A slider, preferably two, is received in the opposing channels with a ball and socket connection between the lift plate and the slider. The ball and socket connection permits relative movement between the lift plate and the guide such that the window may travel in the helical path as the sliders move in the straight drive path.

10 Claims, 2 Drawing Sheets

VEHICLE DOOR AND WINDOW REGULATOR ASSEMBLY FOR DRIVING A WINDOW IN A HELICAL PATH

BACKGROUND OF THE INVENTION

This invention relates to window regulator assembly, and more particularly, the invention relates to a guide and lift plate for a drum and cable window regulator assembly.

Two common window regulator assemblies are a drum and cable assembly and an arm and sector assembly. A drum and cable assembly operates in a generally vertical direction by moving a lift plate along a guide. A cable wrapped around a drum, which is driven manually or automatically, is connected to the lift plate to move the lift plate along the guide. The guide has a slight helical twist along its length, which can be around 10°, to define the window path or glass drop in the door. The guide has opposing flanges that extend outwardly away from one another. The lift plate includes a plastic member overmolded onto a portion of the lift plate and is slidingly arranged on one of the flanges. Overmolding the plastic onto the lift plate requires a dedicated mold, which is expensive. Furthermore, it is expensive to make the helix into the guide for the window drop.

It is desirable for drum and cable and arm and sector regulator assemblies to share as many components as possible. However, arm and sector assemblies operate in generally horizontal direction in that parallel guides are arranged horizontally and is incompatible with drum and cable assemblies. A scissor-like assembly moves in the straight guides to raise and lower the window. Butterfly sliders are received in the guides and include a ball and socket arrangement to connect the lift plate to the sliders. The ball and socket permits movement between the guide and lift plate to accommodate any glass drop about a horizontal axis. Therefore, what is needed is a drum and cable window regulator assembly that eliminates some of its expensive features and commonizes window regulator components.

SUMMARY OF THE INVENTION AND ADVANTAGES

The present invention provides a door including a portion that defines a helical path. A drive assembly includes an actuator couple to a cable for moving the window along the helical path. A single guide having opposing channels extends longitudinally and defines a drive path, which may be straight. A lift plate is movable along the guide for supporting the window, and the cable is connected to the lift plate for moving the lift plate along the guide. A slider, preferably two, is received in the opposing channels with a ball and socket connection between the lift plate and the slider. The ball and socket permits relative movement between the lift plate and the guide such that the window may travel in the helical path as the sliders move in the straight drive path.

Accordingly, the above invention provides a drum and cable window regulator assembly that eliminates some of its expensive features and commonizes window regulator components.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1:
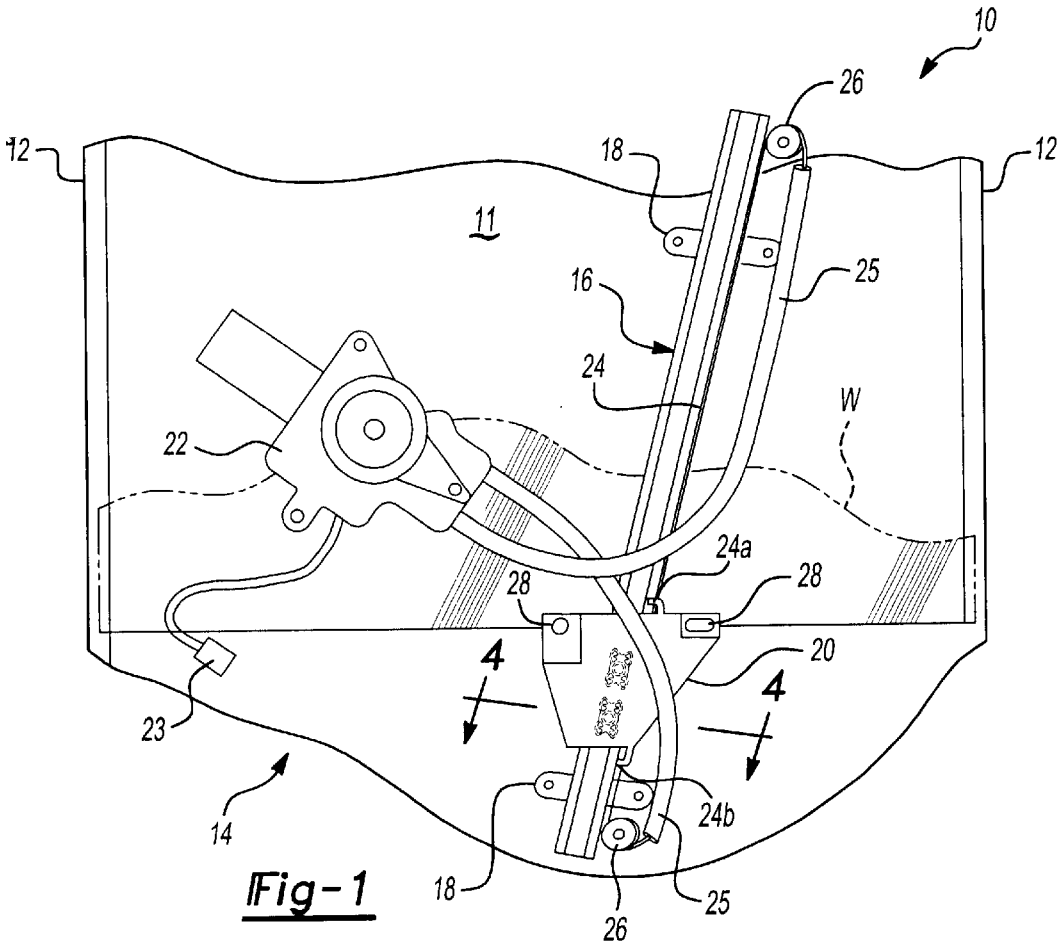
FIG. 1 is a front elevational view of a drum and cable window regulator assembly utilizing the present invention guide and lift plate.

A portion of a door 10 is schematically shown in FIG. 1. The door 10 includes support structure 11 to which various components may be attached. Portions 12 are supported on the door structure 11 to guide a window W, which is shown in phantom, between open and close positions. The window W typically moves along a slight helical path defined by the portions 12 as the window W moves between positions.

A window regulator 14 moves the window W between the open and closed positions. A guide 16 is secured to the support structure 11 by brackets 18 in a generally vertical direction that is typically used for drum and cable regulator assembly configurations. The guide 16, which is generally straight, defines a drive path that is different than the helical path. That is, the guide does not have a helical bend typically used for drum and cable assembly guides. A lift plate 20 is supported in the guide 16 and supports the window W by a member (not shown) secured to apertures 28. An actuator 22, such as an electric motor, is connected to a cable 24 that is secured to the lift plate 20. Typically, the cable 24 includes opposing ends 24*a*, 24*b* that is secured to opposite ends of the lift plate 20. The cable 24 is fed to pulleys 26 through tubes 25 along side the exterior of the guide 16. With the prior art, the cable 24 was arranged within the guide 16, which caused wear to the cable. Depending upon the direction of rotation of the motor 22, one end of the cable 24 pulls the lift plate 20 in either an upward or downward direction to close or open the window W.

Figure 2:
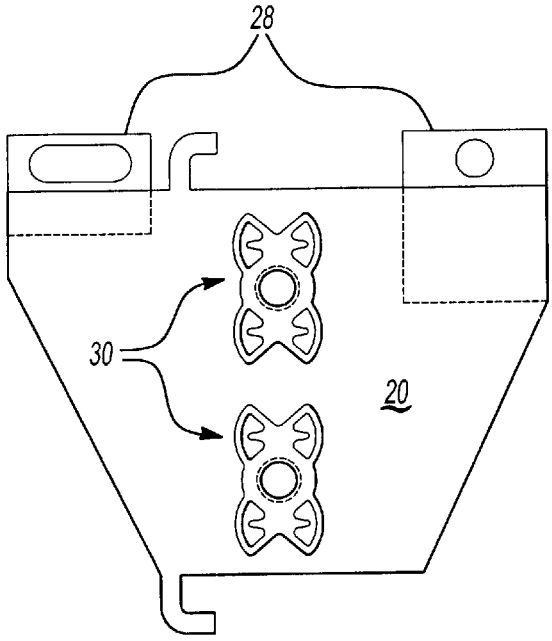
FIG. 2 is a rear elevational view of the present invention lift plate.
Figure 3:
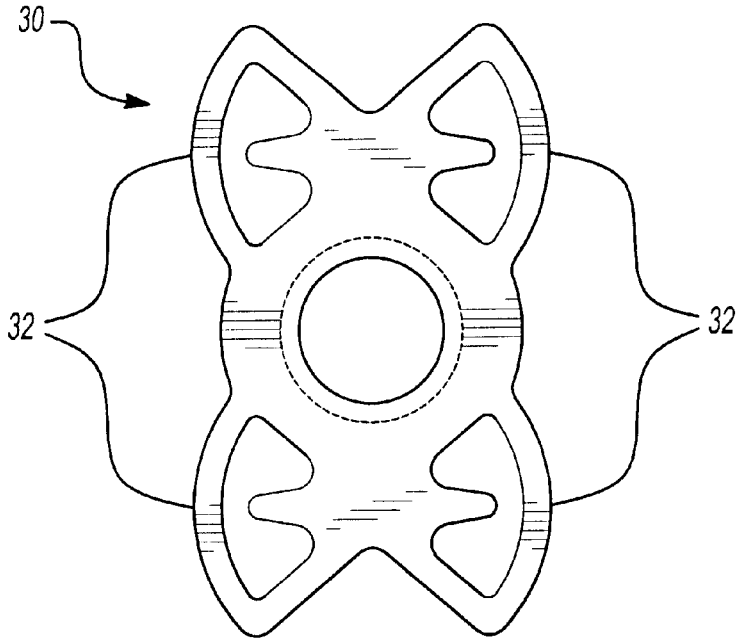
FIG. 3 is a top elevational view of a butterfly slider.
Figure 4:
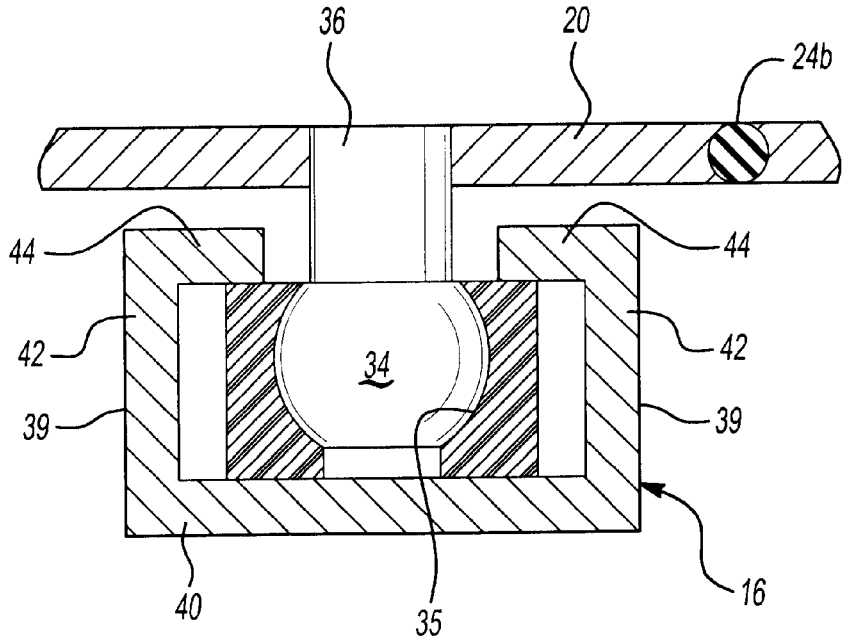
FIG. 4 is cross-sectional view of the present invention guide and lift plate taken along line 4—4 of FIG. 1.

The present invention incorporates sliders 30, best shown in FIGS. 2 and 3, that are received in the guide 16. The sliders 30, which are known in the art, are a butterfly shape and include flexible side portions 32 that laterally locate the slider within the guide 16. Referring to FIG. 4, the body of the slider 30 includes a socket 35 that receives a ball 34. A protrusion 36, such as a rivet, extends from the ball 34 and is secured to the lift plate 20. Preferably, a pair of sliders 30 is secured to the lift plate 20 to provide stability the window W as it moves up and down.

The guide 16 is constructed from a C-shaped member that includes spaced apart facing channels 39 extending longitudinally. The guide 16 includes a main wall 40 and spaced lateral portions 42 that extend in the same direction from the main wall 40. Lips 44 extend from each of the lateral portions 42 toward one another. The flexible side portions 32 of the slider 30 are retained in the channels 39 and coact with the lateral portions 42 to stabilize the window W.

As the lift plate 20 moves in the guide 16 along the drive path, the window W is moved along the helical path defined by the door portions 12. The ball and socket connection between the lift plate 20 and guide 16 provided by the slider 30 permits the lift plate 20 to move in a helical path relative to the non-helical path of the drive path. In this manner, the overmolded member and helical bent flanged guide of prior art drum and cable regulator assemblies may be eliminated. Furthermore, a guide and butterfly slider only used in arm and sector regulator assemblies may be used to reduce cost by commonizing components between regulator assemblies.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A door with a window regulator assembly comprising:

a portion of said door comprising window guides defining a helical path;

said regulator assembly comprising a drive assembly including an actuator coupled to a cable for moving a window along said helical path and including a single guide having opposing channels extending longitudinally and defining a drive path different than said helical path;

a lift plate movable along said single guide for supporting said window with said cable connected to said lift plate for moving said lift plate along said single guide; and a slider received in said opposing channels with a ball and socket connecting said lift plate and said slider, said ball and socket permitting relative movement between said lift plate and said single guide for permitting said window to travel in said helical path as said slider moves along said drive path.

2. The door according to claim 1, wherein said single guide has a generally C-shaped cross-section with a main wall portion, spaced apart opposing lateral portions extending from said main wall portion, and opposing lips on said lateral portions to form said opposing channels, with portions of said slider retained between said lips and said main wall portion.

3. The door according to claim 1, wherein said slider includes flexible side portions disposed between said opposing channels.

4. The door according to claim 1, wherein said lift plate includes said ball which is received in a socket formed in said slider with said ball including a protrusion secured to said lift plate.

5. The door according to claim 1, wherein said slider comprises a pair of said sliders each received by said opposing channels and secured to said lift plate.

6. The door according to claim 1, wherein said actuator is an electric motor.

7. The door according to claim 1, wherein said single guide is oriented in a generally vertical direction within said door.

8. The door according to claim 1, wherein said cable includes opposing ends connected to the lift plate for pulling said lift plate in opposing directions.

9. The door according to claim 1, wherein said cable is arranged proximate to an exterior portion of said single guide.

10. The door according to claim 1, wherein longitudinal centers of said channels are generally coplanar.

* * * * *

UNITED STATES PATENT AND TRADEMARK OFFICE

CERTIFICATE OF CORRECTION

PATENT NO. : 6,550,185 B2
DATED : April 22, 2003
INVENTOR(S) : Stanley Schlatter It is certified that error appears in the above-identified patent and that said Letters Patent is hereby corrected as shown below:

Title page,
Item [75], the inventors name should read as follows:
-- [75] Inventor: Stanley Schlatter --

Signed and Sealed this

Nineteenth Day of August, 2003

JAMES E. ROGAN
*Director of the United States Patent and Trademark Office*